United States Patent [19]

Van Boxtel

[11] Patent Number: 4,947,498

[45] Date of Patent: Aug. 14, 1990

[54] PORTABLE COLLAPSIBLE BED

[76] Inventor: Leonardus J. J. Van Boxtel, Kloosterstraat 32, Goirle, Netherlands, 5051 RD

[21] Appl. No.: 389,975

[22] Filed: Aug. 7, 1989

[30] Foreign Application Priority Data

Mar. 20, 1989 [NL] Netherlands ..... 8900683

[51] Int. Cl.[5] ..... A45F 4/02

[52] U.S. Cl. ..... 5/113; 5/114; 224/155; 224/156

[58] Field of Search ..... 5/111–114; 224/154–156

[56] References Cited

U.S. PATENT DOCUMENTS

| | | | |
|---|---|---|---|
| 46,195 | 1/1865 | Weber | 224/154 |
| 3,619,827 | 11/1971 | Mackenzie | 5/113 |
| 3,822,422 | 7/1974 | Buntyn | 5/114 |
| 3,828,792 | 8/1974 | Cerchione | 5/112 X |
| 3,912,138 | 10/1975 | Pava | 224/154 |
| 4,538,750 | 9/1985 | Hanna | 5/114 X |

FOREIGN PATENT DOCUMENTS

| | | | |
|---|---|---|---|
| 0018772 | 11/1980 | European Pat. Off. . | |
| 0303513 | 2/1989 | European Pat. Off. . | |
| 2224104 | 10/1974 | France . | |
| 7404367 | 10/1974 | Netherlands . | |
| 905604 | 9/1962 | United Kingdom | 5/114 |
| 2191682 | 12/1987 | United Kingdom . | |

*Primary Examiner*—Michael F. Trettel

*Attorney, Agent, or Firm*—Young & Thompson

[57] ABSTRACT

A portable collapsible bed, comprising a mainframe having opposite ends and having legs adjacent each end. A subframe having opposite ends has one end pivotally connected to one end of the mainframe. The subframe has collapsible legs spaced a substantial distance from the other end of the subframe but closer to that other said end than to the one end of the subframe. The legs of the subframe define a seating face. The legs of the subframe are releasably secured in a first position at a substantial angle to the subframe, and are mounted for swinging movement from that first position in a direction away from the one end of the subframe into a second position in which the subframe legs lie against the other end of the subframe, that is, the end remote from the mainframe.

5 Claims, 4 Drawing Sheets

PORTABLE COLLAPSIBLE BED

FIELD OF THE INVENTION

Subject invention relates to a portable collapsible bed, comprising a mainframe near its ends provided only with leg means, and pivotably connected therewith provided with a subframe having leg means.

THE PRIOR ART

Such an collapsible bed is known from EP-A-0 018 772. Therein more a collapsible bed is described, which can be worn as a rucksack supported by belts. In the void between the leg means of the mainfraim the rucksack proper can be received. Referring to another structure described in this application a seat is described, which as collapsible and can be worn as a rucksack. However it is not possible to embody one of these structures both as bed and as seat, unless very complicated locking means are used for locking the subfraim in two positions relative to the mainfraim. Furthermore no suggestion is made to use such locking means.

OBJECT OF THE INVENTION

The invention aims to provide a collapsible bed as described above, which can also be used as a collapsible seat in a relatively simple way.

BRIEF SUMMARY OF THE INVENTION

This aim is realized in a collapsible bed as described above in that the leg means of the subframe are spaced substantially from the free end of the subframe and arranged to provide a seating surface. Because in contrast to the structure shown in EP-A-0 018 772 the leg means of the subframe function as the seating surface and not the part of the mainframe between the leg means, the collapsible bed can also function as a seat. If the leg means of the subframe are conventionally connected thereto, such as with the structure of the collapsible bed according to the cited European specification, these do project when worn as a backpack. This means for a relatively slender wearer that two dangerous protruding parts are present at its sides and for a relatively large wearer that he is confined between the leg means. Furthermore with such a structure the seating surface to be positioned between the leg means of the subframe has to be removed every time. To avoid this drawback according to a further embodiment of the invention the leg means of the subframe are pivotingly arranged with regard to the subframe. During wearing of the collapsible bed, these leg means are collapsed, such that the wearer is not restricted at all. Because of this the device can be dimensioned without regard to the size of the wearer. To absorb the forces arising during sitting on the leg means of the subframe, linking means are provided, having an extremity near the free extremity of the leg means of the subframe connectable, and having the other end connected, to the subframe.

If such a collapsible bed also has to be used as a stretcher, the problem arises that if one engages the free extremities of the main-, subframe respectively to carry a person, the bed will collapse. To prevent this, releasable connection means are provided to be connected with one end near the free extremity of the leg means of the mainframe, and to be connected also with the free end of the mainframe, subframe respectively. In this way the releasable connection means prevent collapsing.

According to a further embodiment of the subject invention in the free extremity of at least one of the mainframe and the subframe a slidable brace is provided. This brace can function as the foot-end and/or head-end of the collapsible bed.

According to a further preferred embodiment the bed according to the invention has means to provide a tent construction.

BRIEF DESCRIPTION OF THE DRAWINGS

The invention will be further elucidated referring to an embodiment shown in the figures, wherein:

FIG. 3 shows the bed according to the invention used as seating and

DETAILED DESCRIPTION OF THE INVENTION

Figure 1:
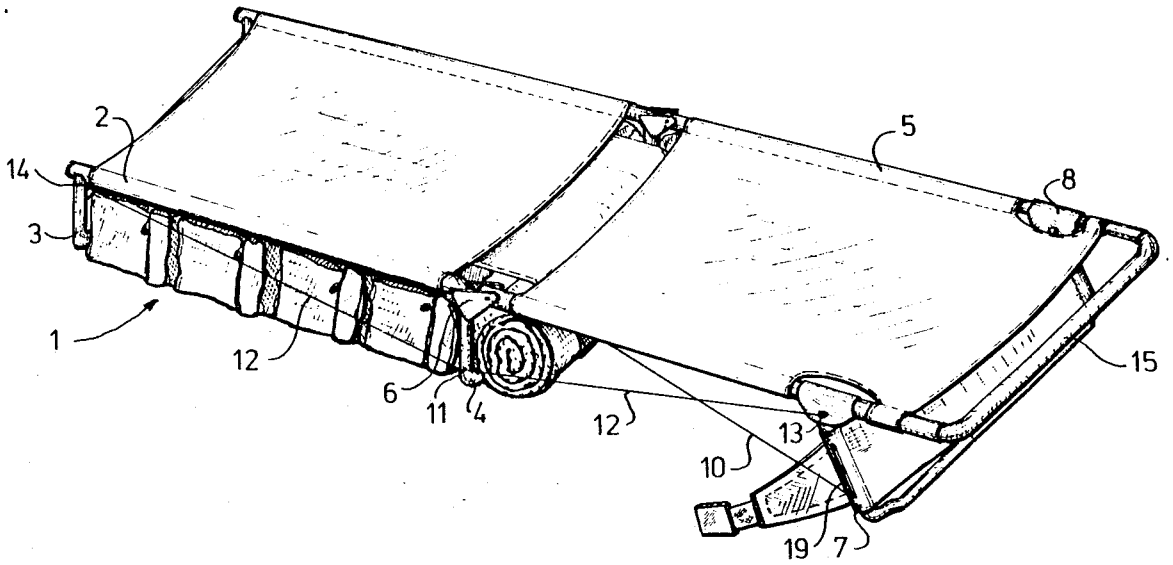
FIG. 1 shows perspectively in extended position the bed according to the invention.
Figure 2:
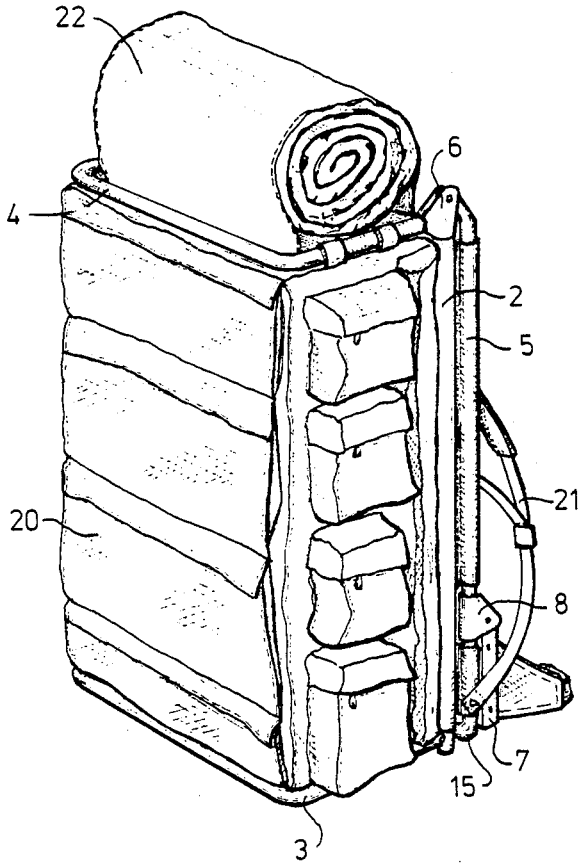
FIG. 2 shows the bed according to FIG. 1 in collapsed position ready for wearing.
Figure 2:
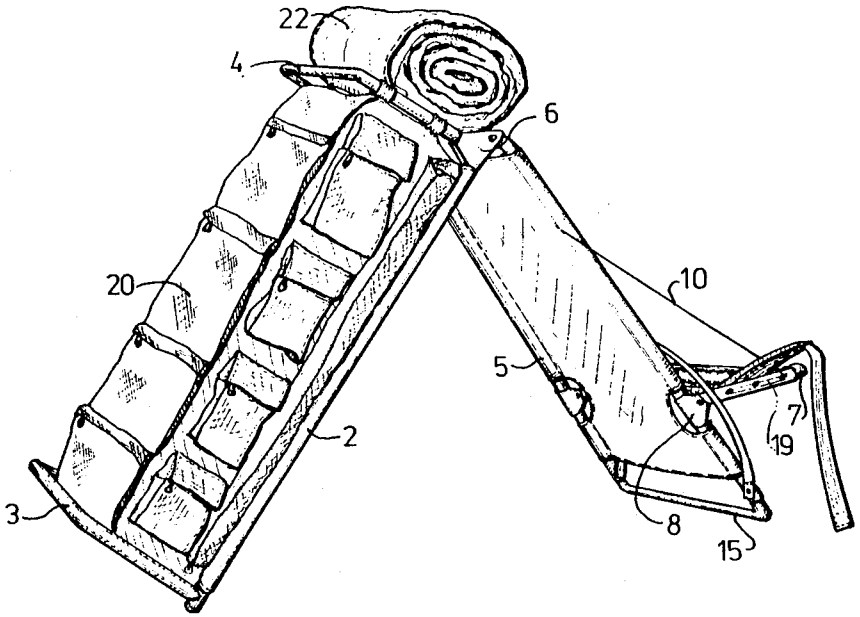

In FIG. 1 the bed according to the invention is shown in extended position and generally indicated with 1. This bed 1 comprises a mainframe 2 provided with U-shaped legs 3 and 4. Subframe 5 is pivotably connected to mainframe 2. The pivot is indicated at 6. Near the free extremity of subframe 5 leg 7 is provided. This leg 7 is connected with subframe 5 through pivot 8. Near the free end of leg 7 seating cable 10 is connected. Furthermore leg 4 is provided with connection means 11 for securing of a structure cable 12, secured at its ends to points 13 and 14 of the subframe, mainframe respectively. Subframe 2 is at the end, away from the end where pivot 6 is arranged, provided with free openings wherein a brace 15 can beslidably introduced. In the condition shown in FIG. 1 it is possible to carry the extended bed near its extremities. The tendency to collapse along pivot 6 is counteracted by the provision of the releasable stretcher cable 12. If this cable is released subframe 5 can collapse against mainframe 2. It is also possible to swivel leg 7 against subframe 5. This condition is shown in FIG. 2, wherein furthermore a rucksack 20 is shown as well as a number of supporting belts 21 to wear the device as a backpack. Collapsing of legs 7 can take place either counter clockwise or clockwise as seen in FIG. 1. In the case of counter clockwise rotating, i.e. to brace 15, in leg 7 a guide 19 is provided, in which the adjacent end of the seating cable connection 10 can be moved to and fro lengthwise of leg 7 so as to support leg 7 as a seat in the position shown in FIG. 3 or to permit leg 7 to fold the carrying position shown in FIG. 2. Pin means (not shown) are provided near the lower end of wire 19 for engaging of cable 10 in the extended position. This embodiment is shown in FIGS. 1 and 2. The embodiment shown in FIG. 2 is ready for wearing. It is clear that not only leg 3 can function to support rucksack 20 but also leg 4 can support a further article such as a sleeping-bag 22.

In FIG. 3 the bed used as a seat is shown. In contrast to the condition shown in FIG. 2 leg 7 is now tilted outwardly. By its collapsible nature one is not troubled by leg 7 such as with the prior art, but nevertheless a comfortable seating surface is provided.

Figure 4:
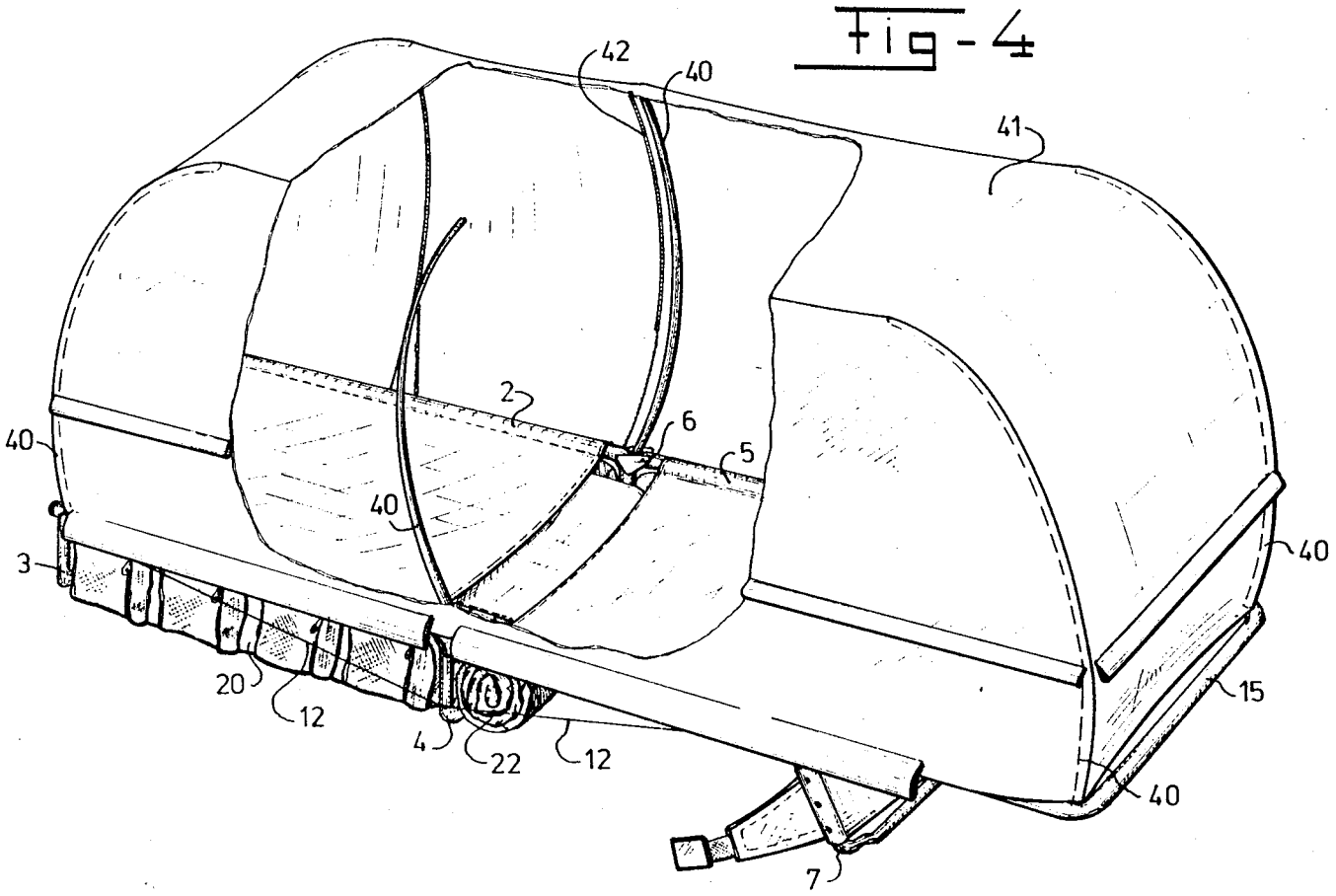
FIG. 4 shows the collapsible bed used as a baseframe for a tent structure.

Finally in FIG. 4 a further use of the collapsible bed according to the invention is given. This function is as a base frame for a schematically shown tent, comprising glass fibre ribs 40 over which in a usual way tenting fabric 41 is provided. An access-zipper 42 can be provided. Rucksack 20 and sleeping-bag 22 can be stored in this embodiment below the tent. This embodiment has as advantage that the user sleeps somewhat above the ground such that no problems with regard to low temperature are experienced, he can store his goods carefully beneath him and he can lie in a very restricted space in a comfortable way. By having the goods placed under the tent in this way these are also protected against external influences.

Although the embodiment described above is a preferred embodiment, it has to be understood that several modifications can be provided without departing from the scope of the subject invention as claimed.

I claim:

1. A portable collapsible bed, comprising a mainframe having opposite ends and having adjacent each said end leg means, a subframe having opposite ends, one end of said subframe being pivotally connected to one end of said mainframe, said subframe having collapsible leg means spaced a substantial distance from the other said end of said subframe but closer to said other said end than to said one end of said subframe, means on said leg means of said subframe defining a seating face, means releasably securing said leg means of said subframe in a first position at a substantial angle to said subframe, and means mounting said leg means of said subframe for swinging movement from said first position in a direction away from said one end of said subframe into a second position in which said leg means of said subframe lie against said other end of said subframe.

2. A bed according to claim 1, and releasable connection means connected to a free end of said leg means of said mainframe which is adjacent said subframe, on the one hand, and to said ends of said mainframe and said subframe which are remote from the pivotal connection between said mainframe and subframe, on the other hand.

3. A bed according to claim 1, said subframe having at said other end thereof two hollow legs, and a brace slidably positioned in and extending between said two hollow legs.

4. A bed according to claim 1, and tent structure removably engageable with said mainframe and said subframe.

5. A bed as claimed in claim 1, wherein said leg means of said subframe comprise two legs one pivotally mounted on each side of said subframe and having ends remote from their pivotal connection which are interconnected by a rigid cross piece.

* * * * *